US011078552B2

(12) United States Patent
Shiimori et al.

(10) Patent No.: US 11,078,552 B2
(45) Date of Patent: Aug. 3, 2021

(54) HIGH-STRENGTH STEEL SHEET AND METHOD FOR MANUFACTURING THE SAME

(71) Applicant: JFE STEEL CORPORATION, Tokyo (JP)

(72) Inventors: Fusae Shiimori, Tokyo (JP); Shinjiro Kaneko, Tokyo (JP); Yasunobu Nagataki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 325 days.

(21) Appl. No.: 16/082,158

(22) PCT Filed: Jan. 30, 2017

(86) PCT No.: PCT/JP2017/003154
§ 371 (c)(1),
(2) Date: Sep. 4, 2018

(87) PCT Pub. No.: WO2017/154401
PCT Pub. Date: Sep. 14, 2017

(65) Prior Publication Data

US 2019/0093190 A1 Mar. 28, 2019

(30) Foreign Application Priority Data

Mar. 7, 2016 (JP) ..... JP2016-042982

(51) Int. Cl.
*C21D 8/02* (2006.01)
*C21D 9/46* (2006.01)
(Continued)

(52) U.S. Cl.
CPC ..... *C21D 8/0247* (2013.01); *C21D 8/02* (2013.01); *C21D 8/0205* (2013.01); *C21D 9/46* (2013.01);
(Continued)

(58) Field of Classification Search
CPC ..... C21D 8/0247; C21D 8/02; C21D 8/0205; C21D 9/46; C21D 2211/001;
(Continued)

(56) References Cited

U.S. PATENT DOCUMENTS

2015/0184274 A1* 7/2015 Kakiuchi ..... C21D 9/46 428/659
2018/0044752 A1* 2/2018 Murata ..... C21D 6/005

FOREIGN PATENT DOCUMENTS

EP 2980243 A1 2/2016
EP 3101147 A1 12/2016
(Continued)

OTHER PUBLICATIONS

Dec. 21, 2018 extended European Search Report issued in European Patent Application No. 17762747.8.
(Continued)

*Primary Examiner* — Anthony J Zimmer
*Assistant Examiner* — Ricardo D Morales
(74) *Attorney, Agent, or Firm* — Oliff PLC

(57) ABSTRACT

A high-strength steel sheet exhibiting excellent ductility and stretch-flangeability, and a method for manufacturing such a high-strength steel sheet. The high-strength steel sheet has a chemical composition including specific proportions of components in which C/Mn is 0.08 to 0.20, the balance being iron and inevitable impurities, and includes microstructures including, in terms of area fraction relative to all the microstructures, 40% to 70% total of ferrite and bainitic ferrite, 5% to 35% martensite and 5% to 30% retained austenite. The proportion of martensite (including retained austenite) adjacent to bainitic ferrite is not less than 60% of all martensite (including retained austenite). The proportion of 4.0 GPa and smaller differences in microhardness measured at 0.5 μm intervals is not less than 70%. The propor-
(Continued)

· MARTENSITE (INCLUDING RETAINED AUSTENITE) ADJACENT TO BAINITIC FERRITE: a, b

· MARTENSITE (INCLUDING RETAINED AUSTENITE) NOT ADJACENT TO BAINITIC FERRITE: c tion of microstructures with 8.0 GPa or smaller microhardness is not less than 85% of all the microstructures.

15 Claims, 1 Drawing Sheet

(51) Int. Cl.

| | |
|---|---|
| ***C22C 38/06*** | (2006.01) |
| ***C23C 2/06*** | (2006.01) |
| ***C23C 2/28*** | (2006.01) |
| ***C22C 38/00*** | (2006.01) |
| ***C22C 38/02*** | (2006.01) |
| ***C22C 38/04*** | (2006.01) |
| ***C22C 38/38*** | (2006.01) |
| ***C23C 2/12*** | (2006.01) |
| ***C23C 2/02*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |

(52) U.S. Cl.

CPC ..... *C22C 38/00* (2013.01); *C22C 38/001* (2013.01); *C22C 38/02* (2013.01); *C22C 38/04* (2013.01); *C22C 38/06* (2013.01); *C22C 38/38* (2013.01); *C23C 2/02* (2013.01); *C23C 2/06* (2013.01); *C23C 2/12* (2013.01); *C23C 2/28* (2013.01); *C21D 2211/001* (2013.01); *C21D 2211/002* (2013.01); *C21D 2211/005* (2013.01); *C21D 2211/008* (2013.01); *C22C 38/002* (2013.01); *C22C 38/005* (2013.01); *C22C 38/08* (2013.01); *C22C 38/12* (2013.01); *C22C 38/14* (2013.01); *C22C 38/16* (2013.01); *C22C 38/22* (2013.01)

(58) Field of Classification Search

CPC ..... C21D 2211/002; C21D 2211/005; C21D 2211/008; C22C 38/00; C22C 38/001; C22C 38/02; C22C 38/04; C22C 38/06; C22C 38/38; C22C 38/002; C22C 38/005; C22C 38/08; C22C 38/12; C22C 38/14; C22C 38/16; C22C 38/22; C23C 2/02; C23C 2/06; C23C 2/12; C23C 2/28

See application file for complete search history.

(56) References Cited

FOREIGN PATENT DOCUMENTS

| | | | |
|---|---|---|---|
| EP | 3178949 | A1 | 6/2017 |
| EP | 3187601 | A1 | 7/2017 |
| EP | 3279363 | A1 | 2/2018 |
| KR | 20170130578 | A | 11/2017 |
| WO | 2015/115059 | A1 | 8/2015 |
| WO | 2016/021195 | A1 | 2/2016 |
| WO | 2016/021196 | A1 | 2/2016 |

OTHER PUBLICATIONS

Sep. 23, 2019 Office Action issued in Korean Patent Application No. 10-2018-7024593.

Mar. 9, 2020 Notice of Allowance issued in Korean Patent Application No. 10-2018-7024593.

Sep. 30, 2019 Office Action issued in Chinese Patent Application No. 201780014327.6.

Mar. 16, 2020 Office Action issued in Chinese Patent Application No. 201780014327.6.

* cited by examiner

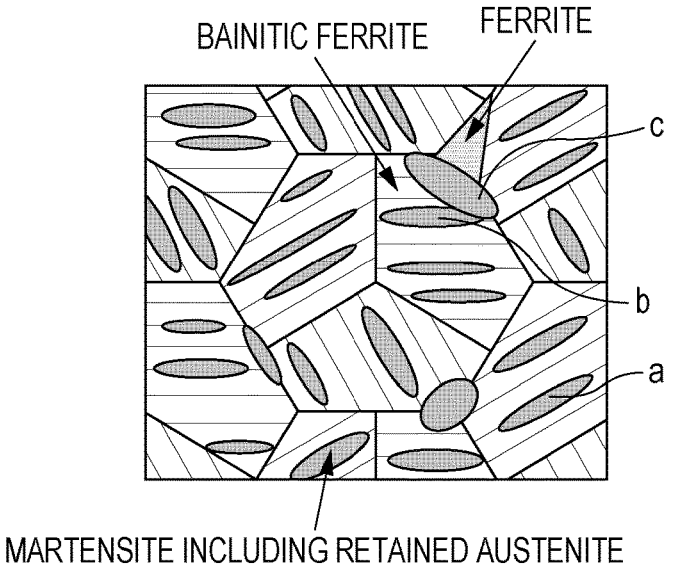
· MARTENSITE (INCLUDING RETAINED AUSTENITE) ADJACENT TO BAINITIC FERRITE: a, b
· MARTENSITE (INCLUDING RETAINED AUSTENITE) NOT ADJACENT TO BAINITIC FERRITE: c

HIGH-STRENGTH STEEL SHEET AND METHOD FOR MANUFACTURING THE SAME

TECHNICAL FIELD

The present disclosure relates to a high-strength steel sheet with 980 MPa or higher tensile strength (TS) excellent in ductility and stretch-flangeability and suited for pressing of complicated shapes such as automobile parts, and to a method for manufacturing such steel sheets.

BACKGROUND ART

In recent years, automobile bodies have been more lightweight to meet demands for enhanced fuel efficiency of automobiles from the point of view of global environment preservation. Further, automobile bodies are required to be improved in crash safety from the point of view of the safety of passengers in case of a crash. These demands have led to an increased use of high-strength steel sheets with 980 MPa or higher TS for automobile bodies.

In general, however, ductility and stretch-flangeability are decreased when strength of steel sheets is increased. Thus, there has been a demand for the development of high-strength steel sheets which exhibit high ductility and high stretch-flangeability while having an increased strength.

To meet these demands, for example, Patent Literature 1 discloses a high-strength steel sheet with enhanced ductility and stretch-flangeability which is obtained by treating a steel sheet containing martensite phases and retained austenite phases in a total fraction of not less than 90% relative to all the metal microstructures, in such a manner that the steel sheet is heated and held at a temperature of not more than $Ac_3$ point and not less than $Ac_3$ point minus 50° C., cooled to or below Ms point and tempered, thereby forming metal microstructures largely composed of fine tempered martensite phases and controlling the volume ratio of retained austenite phases to not more than 3%.

Patent Literature 2 discloses a high-strength steel sheet with excellent delayed fracture resistance which involves Mo and V as essential elements and has microstructures including not less than 70% by area of one or more of martensite, tempered martensite and bainite, and not more than 5% by area of retained austenite.

Patent Literature 3 discloses a high-strength cold-rolled steel sheet with excellent coating adhesion and ductility which has microstructures including tempered martensite, ferrite and retained austenite and has a controlled number of Mn—Si composite oxide particles on the surface of the steel sheet and a controlled ratio of Si-based oxide covering the surface of the steel sheet.

CITATION LIST

Patent Literature

PTL 1: Japanese Patent No. 4291860
PTL 2: Japanese Patent No. 4362319
PTL 3: Japanese Patent No. 3889768

SUMMARY

Technical Problem

Although Patent Literature 1 attains high stretch-flangeability by constructing metal microstructures largely composed of fine tempered martensite phases, a volume ratio of retained austenite phases is as low as 3% or below. On account of this, the elongation (EL) when the tensile strength is 980 MPa or above is 16% at the best, and ductility is insufficient.

Patent Literature 2 only specifies an addition of expensive Mo and V as essential elements, and is silent with respect to workability. In fact, ductility is unsatisfactory because of low volume fraction of retained austenite.

Patent Literature 3 sometimes fails to attain a sufficient balance between TS and λ due to a volume fraction of tempered martensite being excessively high.

In light of the problems discussed above, an object of the present disclosure is to provide a high-strength steel sheet excellent in ductility and stretch-flangeability while having a TS of not less than 980 MPa, and a method for manufacturing such high-strength steel sheets.

Solution to Problem

The present inventors carried out extensive studies directed to achieving the above object, and have consequently found the following. A steel sheet is designed to have microstructures in which the total of bainite and martensite both having a grain size of 1 μm to 25 μm and a block interval of not more than 3 μm represents not less than 80% of all the microstructures of the steel sheet. This steel sheet is treated while strictly controlling a rate of heating to annealing temperature, an annealing temperature, a rate of cooling after annealing, and a cooling end temperature so as to control the area fractions of ferrite, bainitic ferrite, martensite and retained austenite in the metal microstructures relative to the whole of the microstructures in the steel sheet. Further, the proportion of martensite (including retained austenite) adjacent to bainitic ferrite, and the difference in nano hardness (hereinafter, also referred to as microhardness) are controlled. Consequently, a high-strength steel sheet is obtained which exhibits markedly higher ductility and stretch-flangeability than heretofore obtained and which also has TS of not less than 980 MPa. The present disclosure has been completed based on the above findings.

Exemplary embodiments of the present disclosure are as described below.

[1] A high-strength steel sheet having a chemical composition including, in mass %, C: 0.10% to 0.35%, Si: 0.5% to 2.0%, Mn: 1.5% to 3.0%, P: not more than 0.050%, S: not more than 0.0100%, Al: 0.001% to 1.00% and N: 0.0005% to 0.0200%, the balance being iron and inevitable impurities, C/Mn being 0.08 to 0.20, the steel sheet having microstructures including, in terms of area fraction relative to all the microstructures, 40% to 70% total of ferrite and bainitic ferrite, 5% to 35% martensite and 5% to 30% retained austenite, a proportion of martensite (including retained austenite) adjacent to the bainitic ferrite being not less than 60% of all martensite (including retained austenite), a proportion of 4.0 GPa and smaller differences in microhardness measured at 0.5 μm intervals being not less than 70% of all indentations, a proportion of microstructures with 8.0 GPa or smaller microhardness being not less than 85% of all the microstructures.

[2] The high-strength steel sheet described in [1], wherein the chemical composition further includes, in mass %, one, or two or more selected from Ti: 0.005% to 0.100%, Nb: 0.005% to 0.100% and V: 0.005% to 0.100%.

[3] The high-strength steel sheet described in [1] or [2], wherein the chemical composition further includes, in mass %, one, or two or more selected from Cr: 0.05% to 1.0%, Ni: 0.05% to 0.50%, Mo: 0.05% to 1.0%, Cu: 0.005% to 0.500% and B: 0.0001% to 0.0100%.

[4] The high-strength steel sheet described in any one of [1] to [3], wherein the chemical composition further includes, in mass %, either or both of Ca: 0.0001% to 0.0050% and REM: 0.0005% to 0.0050%.

[5] A method for manufacturing a high-strength steel sheet, including providing a steel sheet which has a chemical composition described in any one of [1] to [4] and which includes microstructures in which the total of bainite and martensite both having a grain size of 1 μm to 25 μm and a block interval of not more than 3 μm represents not less than 80% of all the microstructures, heating the steel sheet to 700° C. at an average heating rate of not less than 15° C./sec, holding the steel sheet at a temperature in the range of 740° C. to 860° C. for 60 seconds to 600 seconds, cooling the steel sheet to a temperature in the range of 350° C. to 550° C. at an average cooling rate of not more than 50° C./sec, and subsequently holding the steel sheet at a temperature in the range of 350° C. to 550° C. for 30 seconds to 1200 seconds.

[6] The method described in [5] for manufacturing a high-strength steel sheet, further including performing a coating treatment.

[7] The method described in [6] for manufacturing a high-strength steel sheet, wherein the coating treatment is any of hot dip coating and electrocoating.

[8] The method described in [6] or [7] for manufacturing a high-strength steel sheet, further including performing an alloying treatment at an alloying temperature of 450 to 600° C. after the coating treatment.

In the present disclosure, the term "high-strength steel sheets" refers to steel sheets having a tensile strength (TS) of not less than 980 MPa, and includes hot-rolled steel sheets, cold-rolled steel sheets, and surface-treated hot-rolled or cold-rolled steel sheets such as coated steel sheets and alloy coated steel sheets. In the disclosure, the term "excellent ductility" means that elongation (EL) is 20% or higher, and the term "excellent stretch-flangeability" means that the product of tensile strength (TS) multiplied by hole expansion ratio (λ), namely, stretch-flangeability (TS×λ) is not less than 22000 MPa·%. Further, in the disclosure, the term "steel sheets" means that the sheet thickness is in the range of 1.2 to 6.0 mm for hot-rolled steel sheets and in the range of 0.6 to 2.6 mm for cold-rolled steel sheets and coated steel sheets.

Advantageous Effects

According to the present disclosure, high-strength steel sheets which have TS of not less than 980 MPa and have excellent ductility and stretch-flangeability are obtained. The high-strength steel sheets of the present disclosure are suited for automobile parts which are formed into complicated shapes by pressing forming, by virtue of their excellent ductility and stretch-flangeability with 20% or higher of EL and 22000 MPa·% or higher of TS×λ. Further, the application of structural parts produced in accordance with the present disclosure to automobile bodies realizes an enhancement in crash safety and an enhancement in fuel efficiency which stems from the reduction in body weight, making a significant contribution to the development of the industry. In the present disclosure, the term "excellent workability" may be sometimes used to indicate that the steel sheet is excellent in both ductility and stretch-flangeability.

BRIEF DESCRIPTION OF DRAWING

FIG. 1 is an enlarged partial view illustrating martensite (including retained austenite) adjacent to bainitic ferrite.

DESCRIPTION OF EMBODIMENTS

Hereinbelow, there will be described a chemical composition of the high-strength steel sheets of the present disclosure, appropriate ranges of microstructures, and the reasons why they are limited. In the following, % for the contents of constituents means mass % unless otherwise mentioned.

C: 0.10% to 0.35%

Carbon is an element that contributes to strength, and increases the strength of steel by being dissolved in steel or being precipitated as carbides. Further, carbon is an important element that contributes to enhancing ductility, and is concentrated in retained austenite to increase the stability thereof. To make use of these functions while ensuring that TS will be not less than 980 MPa, 0.10% or more carbon needs to be added. On the other hand, too much carbon excessively increases strength to cause a decrease in stretch-flangeability, and also deteriorates weldability at times. Thus, the upper limitation is 0.35% or below. For the reasons described above, the C content is limited to 0.10% to 0.35%. The C content is preferably not less than 0.18%, and is preferably not more than 0.28%.

Si: 0.5% to 2.0%

Silicon increases the strength of steel by solid solution strengthening, and also increases work hardenability and contributes to improving ductility of ferrite. Further, in the present disclosure, silicon promotes enrichment of austenite with carbon to contribute to the stabilization of retained austenite. To exhibit these functions, 0.5% or more silicon needs to be added. On the other hand, more than 2.0% silicon exhibits saturated effects, and may significantly deteriorate surface quality and cause decreases in chemical conversion properties and coating properties. Thus, the Si content is limited to 0.5% to 2.0%. The Si content is preferably not less than 1.0%, and is preferably not more than 1.66%.

Mn: 1.5% to 3.0%

Manganese contributes to strengthening by allowing martensite to occur in a desired amount. To attain the desired strength in the present disclosure, 1.5% or more manganese needs to be added. On the other hand, adding more than 3.0% manganese results in excessive formation of martensite due to enhanced hardenability. Such excessive formation of martensite raises the proportion of microstructures having more than 8.0 GPa microhardness, and thus causes a decrease in stretch-flangeability. Because manganese has a function to suppress the formation of retained austenite, excessive addition thereof makes it impossible to obtain the desired amount of retained austenite in the present disclosure and thus results in a decrease in workability. For the reasons described above, the Mn content is limited to 1.5% to 3.0%. The Mn content is preferably not less than 1.5%, and is preferably not more than 2.5%.

P: Not More than 0.050%

Phosphorus is inevitably mixed in steel. While this element is effective for the strengthening of steel, the content thereof is limited to 0.050% or below on account of the fact that phosphorus lowers weldability. The P content is preferably not more than 0.030%. While less phosphorus is desirable, dephosphorization to below 0.001% is too costly.

Thus, the lower limit of the P content is preferably 0.001% or above.

S: Not More than 0.0100%

Sulfur is inevitably mixed in steel and causes a significant decrease in local ductility by forming coarse inclusions such as MnS. Thus, the S content is limited to 0.0100% or below. The S content is preferably not more than 0.0050%. Desulfurization to below 0.0001% is too costly. Thus, the lower limit of the S content is preferably 0.0001% or above, and more preferably 0.0005% or above.

Al: 0.001% to 1.00%

Similarly to silicon, aluminum promotes the enrichment of austenite with carbon to help the stabilization of retained austenite. To promote the formation of retained austenite, 0.001% or more aluminum needs to be added. However, adding aluminum in a large amount raises the manufacturing costs. Thus, the Al content is limited to 0.001% to 1.00%. The Al content is preferably not less than 0.03%, and is preferably not more than 0.6%.

N: 0.0005% to 0.0200%

Nitrogen is inevitably mixed in steel, and forms precipitates by bonding to carbonitride-forming elements such as aluminum, thus contributing to enhancing strength and reducing the size of microstructures. To obtain these effects, 0.0005% or more nitrogen needs to be added. On the other hand, aging resistance is decreased if more than 0.0200% nitrogen is contained. Thus, the N content is limited to 0.0005% to 0.0200%.

C/Mn: 0.08 to 0.20

When steel is deformed, retained austenite in the strained region undergoes strain-induced transformation into martensite to give an increased hardness to the deformed portion, thereby preventing localization of strain. As mentioned earlier, carbon contributes to the stabilization of retained austenite while manganese suppresses the formation of retained austenite. On account of this fact, it is necessary that C/Mn be controlled appropriately. If C/Mn is below 0.08, carbon is too little and manganese is too much. Thus, the stability of retained austenite is lowered and, at the same time, the formation of retained austenite is suppressed, with the result that stable retained austenite cannot be formed in the desired amount. If, on the other hand, C/Mn is above 0.20, carbon is too much and manganese is too little. Thus, the C concentration in retained austenite is excessively increased and the strain-induced transformation into martensite results in excessive hardening of martensite to cause a decrease in workability. For the reasons described above, C/Mn is limited to 0.08 to 0.20. The ratio is preferably not more than 0.18.

The balance is iron and inevitable impurities. However, the chemical composition may include components other than those described above as long as the advantageous effects of the present disclosure are not impaired.

While the steel sheets of the present disclosure may attain the desired characteristics by containing the above essential elements, additional elements described below may be added as required in addition to the essential elements.

One, or Two or More Selected from Ti: 0.005% to 0.100%, Nb: 0.005% to 0.100% and V: 0.005% to 0.100%

Titanium, niobium and vanadium form carbonitrides to effect precipitation strengthening and to reduce the grain size. Such functions make these elements useful for the strengthening of steel. To ensure that these functions will be exhibited effectively, titanium, niobium and vanadium are preferably added each in 0.005% or above. The effects are saturated after the contents of titanium, niobium and vanadium each exceed 0.100%. Further, excessive addition is a factor which increases the costs. Thus, the contents are preferably 0.005% to 0.100% titanium, 0.005% to 0.100% niobium, and 0.005% to 0.100% vanadium.

One, or Two or More Selected from Cr: 0.05% to 1.0%, Ni: 0.05% to 0.50%, Mo: 0.05% to 1.0%, Cu: 0.005% to 0.500% and B: 0.0001% to 0.0100%

Chromium, nickel, molybdenum, copper and boron are useful as steel strengthening elements because of their functions to increase hardenability and promote martensite formation. To ensure that these functions will be exhibited effectively, the contents are preferably not less than 0.05% for each of chromium, nickel and molybdenum, not less than 0.005% for copper, and not less than 0.0001% for boron. If more than 1.0% chromium or molybdenum, more than 0.50% nickel, more than 0.500% copper, or more than 0.0100% boron is contained, martensite is formed excessively to cause a risk that ductility may be lowered. Thus, the contents are preferably 0.05% to 1.0% chromium, 0.05% to 0.50% nickel, 0.05% to 1.0% molybdenum, 0.005% to 0.500% copper, and 0.0001% to 0.0100% boron.

Either or Both of Ca: 0.0001% to 0.0050% and REM: 0.0005% to 0.0050%

Calcium and REM have a function to control the morphology of sulfide inclusions, and are effective for suppressing a decrease in local ductility. To ensure that these functions will be exhibited effectively, the contents are preferably not less than 0.0001% calcium and not less than 0.0005% REM. The effects are saturated after the content of calcium or REM exceeds 0.0050%. Thus, the contents are preferably 0.0001% to 0.0050% calcium and 0.0005% to 0.0050% REM.

Next, there will be described important requirements such as metal microstructures of the high-strength steel sheets of the present disclosure. The area fractions discussed below are relative to the whole of the microstructures in the steel sheet.

Area Fraction of Total of Ferrite and Bainitic Ferrite: 40% to 70%

Ferrite is formed during cooling after annealing, and contributes to enhancing the ductility of steel. Bainitic ferrite is formed during a hold at a cooling end temperature, and its formation releases carbon, which is concentrated in austenite to effectively increase the stability of retained austenite. During deformation, retained austenite that has been strained is transformed into martensite which makes the deformed portion harder, thus preventing the localization of strain. If the total area fraction of ferrite and bainitic ferrite is below 40%, it is difficult to ensure ductility. If the total area fraction of ferrite and bainitic ferrite is above 70%, it is difficult to ensure 980 MPa or higher of TS. Thus, the total area fraction of ferrite and bainitic ferrite is limited to 40% to 70%. The total area fraction is preferably not less than 45%, and is preferably not more than 65%. The area fractions of ferrite and bainitic ferrite may be measured by the method described later in EXAMPLES.

The proportions of ferrite and of bainitic ferrite, although not particularly limited, are preferably not more than 10% ferrite relative to all the microstructures, and not less than 75% bainitic ferrite relative to the total of ferrite and bainitic ferrite.

Area Fraction of Martensite: 5% to 35%

In the present disclosure, martensite is introduced as a constituent in the microstructures to ensure strength. If the area fraction of martensite is above 35%, formability cannot be ensured. If, on the other hand, the area fraction of martensite is less than 5%, the desired strength cannot be obtained. Thus, the area fraction of martensite is limited to 5% to 35%. The area fraction is preferably not less than 10%, and is preferably not more than 30%. The area fraction of martensite may be measured by the method described later in EXAMPLES.

Area Fraction of Retained Austenite: 5% to 30%

When steel is deformed, retained austenite in the strained region undergoes strain-induced transformation into martensite to give an increased hardness to the deformed portion, thereby preventing localization of strain. To attain high workability while ensuring 980 MPa or higher of TS, the steel needs to contain 5% or more, by area, of retained austenite. If, on the other hand, the area fraction of retained austenite is above 30%, press forming tends to result in cracks at flanges. Thus, the area fraction of retained austenite is limited to 5% to 30%. The area fraction is preferably not less than 10%, and is preferably not more than 25%. The area fraction of retained austenite may be measured by the method described later in EXAMPLES.

Proportion of Martensite (Including Retained Austenite) Adjacent to Bainitic Ferrite: Not Less than 60% of all Martensite (Including Retained Austenite)

When steel is deformed, retained austenite in the strained region undergoes strain-induced transformation into martensite. The difference in hardness between adjacent microstructures is greater when martensite or retained austenite is adjacent to ferrite than when adjacent to bainitic ferrite. During deformation, interfaces between such microstructures having a greater hardness difference allow the stress to be concentrated there, serving as origins of voids. That is, stretch-flangeability is deteriorated. Thus, the proportion of martensite (including retained austenite) adjacent to bainitic ferrite is limited to not less than 60% of all martensite (including retained austenite). The proportion is preferably not less than 65%.

In the present disclosure, the "martensite (including retained austenite) adjacent to bainitic ferrite" is defined as described below with reference to FIG. 1.

The "martensite (including retained austenite) adjacent to bainitic ferrite" means that the martensite (including retained austenite) is in contact with bainitic ferrite in at least part of its boundary with adjacent microstructures and is not at all in contact with ferrite on its boundary with adjacent microstructures. Specifically, the definition of the "martensite (including retained austenite) adjacent to bainitic ferrite" is true for numerals a and b in FIG. 1, but is not for numeral c.

The proportion defined above may be written as follows.

((Martensite(including retained austenite)adjacent to bainitic ferrite)/(All martensite(including retained austenite))×100≥60

The area fractions of the metal microstructures may be measured by the method described later in EXAMPLES.

Proportion of 4.0 GPa and smaller differences in microhardness measured at 0.5 μm intervals: not less than 70% of all indentations If the difference in microhardness is large, that is, if microstructures adjacent to one another have a large difference in nano-hardness, stress is concentrated to interfaces between such microstructures during deformation, leaving voids there. That is, stretch-flangeability is deteriorated. Thus, the difference in microhardness is limited to not more than 4.0 GPa. Here, the difference in microhardness is defined as the largest value of the differences in microhardness between one site and each of its adjacent sites (each of four sites which are left, right, above and below itself) measured by indentation analysis at 0.5 μm intervals. If the proportion of 4.0 GPa and smaller differences is less than 70%, it is difficult to ensure the desired stretch-flangeability. Thus, the proportion of 4.0 GPa and smaller differences in microhardness measured between one site and each of its adjacent sites (each of four sites which are left, right, above and below itself) at 0.5 μm intervals is limited to not less than 70% of all the indentations (the number of sites analyzed). The proportion is preferably not less than 75%. Here, the microhardness is the hardness measured with a nano indenter. The microhardness may be measured by the method described later in EXAMPLES.

Proportion of Microstructures with 8.0 GPa or Smaller Microhardness: Not Less than 85% of all Microstructures If a large proportion of the microstructures have a microhardness of more than 8.0 GPa, that is, if the microstructures include a high proportion of hard phases, stretch-flangeability is decreased due to the increased strength. Thus, the microhardness is limited to not more than 8.0 GPa. Here, the hard phases are martensite. If the proportion of 8.0 GPa and smaller microhardness is less than 85%, the proportion of hard phases is so high that the consequent increase in strength makes it difficult to ensure stretch-flangeability. Thus, the proportion of microstructures with 8.0 GPa or smaller microhardness is limited to not less than 85% of all the microstructures. The microhardness may be measured by the method described later in EXAMPLES.

Next, there will be described a method for manufacturing a high-strength steel sheet according to the present disclosure.

The method for manufacturing a high-strength steel sheet according to the present disclosure includes providing a steel sheet which has a chemical composition described hereinabove and which includes microstructures in which the total of bainite and martensite both having a grain size of 1 μm to 25 μm and a block interval of not more than 3 μm represents not less than 80% of all the microstructures, heating the steel sheet to 700° C. at an average heat-up rate of not less than 15° C./sec, holding the steel sheet at an annealing temperature of 740° C. to 860° C. for 60 seconds to 600 seconds, cooling the steel sheet to a temperature in the range of 350° C. to 550° C. at an average cooling rate of not more than 50° C./sec, and subsequently holding the steel sheet at a temperature in the range of 350° C. to 550° C. for 30 seconds to 1200 seconds.

Detailed description will be given below.

As a starting steel sheet, use is made of a steel sheet including microstructures in which the area fraction of the total of low-temperature transformed phases (bainite, martensite) having a grain size of 1 μm to 25 μm and a block interval of not more than 3 μm is not less than 80% relative to the area of all the microstructures.

The manufacturing of the above steel sheet will be described. Although the manufacturing method is not particularly limited as long as the above microstructures can be obtained, for example, the following methods may be adopted.

When the starting steel sheet is a hot-rolled steel sheet, steel smelted with the aforementioned chemical composition and cast into a slab is rolled at a heating temperature of not less than 1250° C. and a finishing delivery temperature of not less than 850° C., cooled to a coiling temperature at an average cooling rate of not less than 30° C./sec, and coiled at a coiling temperature of 350° C. to 550° C. Thus obtained hot-rolled steel sheet attains the microstructures described above.

When the starting steel sheet is a cold-rolled steel sheet, steel smelted with the aforementioned chemical composition and cast into a slab is rolled at a heating temperature of not less than 1250° C. and a finishing delivery temperature of not less than 850° C., cooled to a coiling temperature at an average cooling rate of not less than 30° C./sec, and coiled at a coiling temperature of 600° C. to 700° C., and the resultant hot-rolled sheet is pickled with hydrochloric acid, cold rolled with a rolling reduction of not less than 40%, soaked at a temperature of not less than $Ac_3$ transformation point and held at the temperature for 60 seconds to 600 seconds, cooled from the soaking temperature to a cooling end temperature at an average cooling rate of less than 50° C./sec, and, after the cooling is terminated at a temperature of 350° C. to 550° C., held at a temperature in the range of 350° C. to 550° C. for 30 seconds to 1200 seconds. Thus obtained cold-rolled steel sheet attains the microstructures described above.

Here, the $Ac_3$ transformation point may be determined from the Andrews equation below:

$$Ac_3=910-203[C]^{1/2}+45[Si]-30[Mn]-20[Cu]-15[Ni]+11[Cr]+32[Mo]+104[V]+400[Ti]+460[Al]$$

The element symbols in the equation represent the contents (mass %) in the steel sheet. When the element is absent, the element symbol in the equation is 0.

To form low-temperature transformed phases with a grain size of less than 1 μm, the grains need to be reduced in size by, for example, severe plastic deformation. This fact significantly deteriorates productivity. If, on the other hand, the grain size is greater than 25 μm or the block interval is more than 3 μm, the final microstructures tend to contain microstructures with a high microhardness and consequently stretch-flangeability is deteriorated. Further, the final microstructures tend to contain microstructures with a high microhardness and stretch-flangeability is deteriorated also when the proportion of low-temperature transformed phases is below 80%. For the reasons described above, the proportion of low-temperature transformed phases having a grain size of 1 μm to 25 μm and a block interval of not more than 3 μm is limited to not less than 80% of all the microstructures. The proportion is preferably not less than 85%. In the present disclosure, the low-temperature transformed phases are bainite and martensite.

Average Heating Rate to 700° C.: Not Less than 15° C./Sec

If the average heating rate is less than 15° C./sec, the low-temperature transformed phases (bainite and martensite) in the starting microstructures cannot be inversely transformed during heating while maintaining the lath structures, and tend to be precipitated as cementite or tend to join together when they are melted. As a result, the inversely transformed austenite becomes massive and the final microstructures contain an increased proportion of large-microhardness microstructures, thus causing a decrease in stretch-flangeability. For these reasons, the average heating rate to 700° C. is limited to not less than 15° C./sec. The average heating rate is preferably not less than 20° C./sec.

Annealing Temperature: 740° C. to 860° C.

If the annealing temperature is below 740° C., ferrite increases its volume fraction during the annealing and comes to represent a large area fraction in the final microstructures, thus making it difficult to ensure 980 MPa or higher TS. If, on the other hand, the annealing temperature is above 860° C., the low-temperature transformed phases in the microstructures in the starting steel sheet cannot maintain the lath structures during the annealing, with the result that less martensite or retained austenite is adjacent to bainitic ferrite in the final microstructures and the stretch-flangeability is deteriorated. Thus, the annealing temperature is limited to 740° C. to 860° C. The annealing temperature is preferably not less than 760° C., and is preferably not more than 840° C.

Holding Time at Annealing Temperature: 60 Seconds to 600 Seconds

If the holding time at the annealing temperature is less than 60 seconds, carbon and manganese, which are austenite-stabilizing elements, cannot be concentrated sufficiently to austenite during the annealing and consequently the retained austenite in the final microstructures is not sufficiently enriched with carbon and manganese and becomes less stable to cause a decrease in ductility. If, on the other hand, the holding time at the annealing temperature exceeds 600 seconds, austenite increases its fraction during the annealing and consequently martensite in the final microstructures tends to be massive to raise the proportion of microstructures with more than 8.0 GPa microhardness, thus causing a decrease in stretch-flangeability. For these reasons, the holding time at the annealing temperature is limited to 60 seconds to 600 seconds. The holding time is preferably not less than 90 seconds, and is preferably not more than 300 seconds. The holding time at the annealing temperature means the time of a hold at the annealing temperature, namely, in the range of temperatures of 740° C. to 860° C.

Average Cooling Rate: Not More than 50° C./Sec

If the average cooling rate is above 50° C./sec, ferrite and bainitic ferrite are prevented from occurring during the cooling and consequently cannot attain the desired amount of ferrite and bainitic ferrite to cause a decrease in ductility. Thus, the average cooling rate is limited to not more than 50° C./sec. The average cooling rate is preferably not more than 35° C./sec. The cooling may be performed by gas cooling or a combination of other cooling techniques such as furnace cooling, mist cooling, roll cooling and water cooling.

Cooling End Temperature: 350° C. to 550° C.

If the cooling is terminated at a cooling end temperature of above 550° C., the formation of retained austenite is suppressed and the ductility is decreased. If, on the other hand, the cooling end temperature is below 350° C., martensite phases are formed in an excessively large amount to raise the proportion of microstructures with a high microhardness, thus causing a decrease in stretch-flangeability. For these reasons, the cooling end temperature is limited to 350° C. to 550° C. The cooling end temperature is preferably not less than 375° C., and is preferably not more than 500° C.

Holding Time at Temperature in the Range of 350° C. to 550° C.: 30 Seconds to 1200 Seconds If the holding time at 350° C. to 550° C. is less than 30 seconds, retained austenite is hardly obtained in the desired amount and an excessively large amount of martensite is formed, with the result that ductility and stretch-flangeability are decreased. On the other hand, the amount of retained austenite is no longer increased after 1200 seconds of holding, and such an excessively long holding time does not offer a marked enhancement in ductility and only lowers productivity. For these reasons, the holding time at 350° C. to 550° C. is limited to 30 seconds to 1200 seconds. The holding time is preferably 60 seconds to 900 seconds.

The high-strength steel sheets of the present disclosure are manufactured in the above-described manner. The quality of the high-strength steel sheets thus obtained is not affected by a coating treatment or the composition of a coating bath, and the advantageous effects of the present disclosure can be obtained similarly when such coating treatment is performed. The coating treatment may be any of hot dip coating, alloy coating and electrocoating. For example, the steel sheets may be treated into galvanized steel sheets, galvannealed steel sheets, zinc aluminum-coated steel sheets, zinc nickel-coated steel sheets, aluminum-coated steel sheets, zinc magnesium-coated steel sheets, and zinc aluminum magnesium-coated steel sheets.

Coating Treatment (Preferred Conditions)

The steel sheet is coated by being soaked into a coating bath. In the case of, for example, galvanization, the bath temperature is preferably 440 to 500° C. If the bath temperature is below 440° C., zinc is not melted. At above 500° C., the alloying degree of the coating excessively proceeds. The galvanization preferably involves a zinc bath having an Al concentration of 0.10 mass % to 0.23 mass %.

Alloying Treatment, after Coating Treatment, at Alloying Temperature of 450 to 600° C. (Preferred Conditions)

The coated steel sheet may be treated into an alloy coated steel sheet by performing reheating to 450 to 600° C. and holding the steel sheet at the reheating temperature for a predetermined time. If the reheating temperature is below 450° C., the metals are not alloyed sufficiently. If, on the other hand, the reheating temperature exceeds 600° C., untransformed austenite is transformed into pearlite during alloying and the desired volume fraction of retained austenite cannot be ensured at times, resulting in a decrease in ductility. Thus, the alloying temperature is preferably 450 to 600° C. The holding time at the alloying temperature is not particularly limited. However, the metals are not alloyed sufficiently if the holding time is less than 1 second. It is therefore preferable that the lower limit of the holding time be 1 second or more, and more preferably 10 seconds or more. The upper limit of the holding time is preferably 120 seconds or less, and more preferably 30 seconds. The reheating temperature means the temperature of the steel sheet surface.

Other coating conditions (guidelines) such as coating weight and coating apparatus may be determined in accordance with common procedures.

EXAMPLES

Exemplary EXAMPLES will be presented below to illustrate the functions and effects of the high-strength steel sheets according to the present disclosure and the methods for the manufacturing thereof.

Vacuum melted steels having the chemical compositions shown in Table 1 were smelted in a laboratory furnace and were cast into sheet bar slabs with a sheet thickness of 20 mm. The sheet bar slabs were heat treated as if they were rolled at a heating temperature of 1250° C. and a finishing delivery temperature of 880° C. and, after the rolling, the steel sheets were cooled to 650° C. at 40° C./sec and were coiled at 650° C. The hot-rolled sheets were pickled with hydrochloric acid and cold rolled with a rolling reduction of 50% into cold-rolled steel sheets with a sheet thickness of 1.2 mm. Next, the steel sheets were heat treated under the heat treatment conditions described in Table 2. The cold-rolled steel sheets thus obtained were used as starting steel sheets.

Separately, vacuum melted steels having the chemical compositions shown in Table 1 were smelted in a laboratory furnace and were cast into sheet bar slabs with a sheet thickness of 20 mm. The sheet bar slabs were heat treated as if they were rolled at a heating temperature of 1250° C. and a finishing delivery temperature of 880° C. and, after the rolling, the steel sheets were cooled to 450° C. at 50° C./sec and were coiled at 450° C. The hot-rolled steel sheets obtained were used as starting steel sheets.

Next, the starting hot-rolled steel sheets and the starting cold-rolled steel sheets were heated, held at an annealing temperature, cooled, and held at a cooling end temperature under the heat treatment conditions described in Table 2, and thereby hot-rolled steel sheets and cold-rolled steel sheets were obtained. Some of the steel sheets were subsequently soaked in a zinc coating bath containing 0.13 mass % of aluminum at 475° C. for 3 seconds to form zinc coating layers with a coating weight of 45 g/m$^2$ per side, thereby manufacturing galvanized cold-rolled steel sheets. Some of the galvanized cold-rolled steel sheets were subjected to an alloying treatment and were then cooled to give galvannealed cold-rolled steel sheets. Some of the galvanized cold-rolled steel sheets were not alloyed.

TABLE 1

| | Chemical composition (mass %) | | | | | | | | | | |
|---|---|---|---|---|---|---|---|---|---|---|---|
| Steel | C | Si | Mn | P | S | Al | N | Ti | Nb | V | Cr |
| A | 0.24 | 1.43 | 2.12 | 0.015 | 0.0013 | 0.035 | 0.0043 | — | — | — | — |
| B | 0.23 | 1.59 | 2.70 | 0.011 | 0.0011 | 0.052 | 0.0041 | — | — | — | — |
| C | 0.18 | 1.56 | 1.96 | 0.008 | 0.0009 | 0.040 | 0.0044 | 0.018 | — | — | — |
| E | 0.24 | 1.48 | 1.98 | 0.015 | 0.0016 | 0.054 | 0.0029 | 0.012 | — | 0.048 | — |
| F | 0.19 | 0.87 | 2.14 | 0.007 | 0.0012 | 0.040 | 0.0031 | — | — | — | 0.18 |
| G | 0.30 | 1.36 | 1.92 | 0.019 | 0.0015 | 0.039 | 0.0041 | — | 0.018 | — | — |
| H | 0.18 | 1.66 | 2.25 | 0.011 | 0.0008 | 0.052 | 0.0033 | — | — | — | — |
| I | 0.06 | 1.38 | 1.94 | 0.013 | 0.0006 | 0.041 | 0.0035 | — | — | — | — |
| J | 0.40 | 1.76 | 1.75 | 0.015 | 0.0017 | 0.044 | 0.0036 | — | — | — | — |
| K | 0.19 | 0.23 | 2.07 | 0.016 | 0.0008 | 0.031 | 0.0029 | — | — | — | — |
| L | 0.18 | 1.62 | 1.05 | 0.001 | 0.0020 | 0.051 | 0.0038 | — | — | — | — |
| M | 0.26 | 1.79 | 3.52 | 0.011 | 0.0015 | 0.039 | 0.0030 | — | — | — | — |
| N | 0.12 | 1.52 | 2.80 | 0.012 | 0.0018 | 0.045 | 0.0045 | — | — | — | — |

| | Chemical composition (mass %) | | | | | | | $Ac_3$ |
|---|---|---|---|---|---|---|---|---|
| Steel | Ni | Mo | Cu | B | Ca | REM | C/Mn | (° C.) |
| A | — | — | — | — | — | — | 0.11 | 827 |
| B | — | — | — | — | — | — | 0.09 | 827 |
| C | — | — | — | 0.0012 | — | — | 0.09 | 861 |
| E | — | — | — | — | — | — | 0.12 | 852 |
| F | — | 0.11 | — | — | — | — | 0.09 | 820 |

TABLE 1-continued

| | | | | | | | | |
|---|---|---|---|---|---|---|---|---|
| G | 0.21 | — | 0.15 | — | — | — | 0.16 | 814 |
| H | — | — | — | — | 0.0005 | 0.0011 | 0.08 | 855 |
| I | — | — | — | — | — | — | 0.03 | 883 |
| J | — | — | — | — | — | — | 0.23 | 829 |
| K | — | — | — | — | — | — | 0.09 | 784 |
| L | — | — | — | — | — | — | 0.17 | 889 |
| M | — | — | — | — | — | — | 0.07 | 799 |
| N | — | — | — | — | — | — | 0.04 | 845 |

$Ac_3 = 910-203[C]^{1/2} + 45[Si] - 30[Mn] - 20[Cu] - 15[Ni] + 11[Cr] + 32[Mo] + 104[V] + 400[Ti] + 460[Al]$

The element symbols in the equation represent the contents (mass %) in the steel sheet. When the element is absent, the element symbol in the equation is 0.

TABLE 2

| | | Finishing | Coiling | Conditions for heat treatments for forming microstructures of starting steel sheets | | | | | |
|---|---|---|---|---|---|---|---|---|---|
| No. | Steel | delivery temperature (° C.) | temperature (° C.) in hot rolling | $Ac_3$ (° C.) | Soaking temperature (° C.) | Soaking time (sec) | Cooling rate (° C./sec) | Cooling end temperature (° C.) | Holding time (sec) |
| 1 | A | 880 | 650 | 827 | 900 | 100 | 10 | 400 | 400 |
| 2 | A | 880 | 650 | 827 | 900 | 100 | 10 | 400 | 400 |
| 3 | A | 880 | 650 | 827 | 900 | 100 | 10 | 400 | 400 |
| 4 | B | 880 | 650 | 827 | 900 | 100 | 10 | 400 | 400 |
| 5 | C | 880 | 650 | 861 | 900 | 100 | 10 | 400 | 400 |
| 6 | E | 880 | 650 | 852 | 900 | 100 | 10 | 400 | 400 |
| 7 | F | 880 | 650 | 820 | 900 | 100 | 10 | 400 | 400 |
| 8 | G | 880 | 450 | 814 | — | — | — | — | — |
| 9 | H | 880 | 650 | 855 | 900 | 100 | 10 | 400 | 400 |
| 10 | I | 880 | 650 | 883 | 900 | 100 | 10 | 400 | 400 |
| 11 | J | 880 | 650 | 829 | 900 | 100 | 10 | 400 | 400 |
| 12 | K | 880 | 650 | 784 | 900 | 100 | 10 | 400 | 400 |
| 13 | L | 880 | 650 | 889 | 900 | 100 | 10 | 400 | 400 |
| 14 | M | 880 | 650 | 799 | 900 | 100 | 100 | — | — |
| 15 | N | 880 | 650 | 845 | 900 | 100 | 100 | — | — |
| 16 | A | 880 | 650 | 827 | 900 | 1000 | 10 | 400 | 400 |
| 17 | A | 880 | 650 | 827 | 900 | 100 | 10 | 650 | 400 |
| 18 | I | 880 | 650 | 883 | 750 | 100 | 10 | 400 | 400 |
| 19 | C | 880 | 650 | 861 | 900 | 100 | 10 | 400 | 400 |
| 20 | C | 880 | 650 | 861 | 900 | 100 | 10 | 400 | 400 |
| 21 | C | 880 | 650 | 861 | 900 | 100 | 10 | 400 | 400 |
| 22 | C | 880 | 650 | 861 | 900 | 100 | 10 | 400 | 400 |
| 23 | E | 880 | 650 | 852 | 900 | 100 | 10 | 400 | 400 |
| 24 | E | 880 | 650 | 852 | 900 | 100 | 10 | 400 | 400 |
| 25 | E | 880 | 650 | 852 | 900 | 100 | 10 | 400 | 400 |
| 26 | E | 880 | 650 | 852 | 900 | 100 | 10 | 400 | 400 |

| | Microstructures of starting steel sheets | | | | Heat treatment conditions | | | |
|---|---|---|---|---|---|---|---|---|
| No. | Grain size (μm) | Block interval (μm) | Proportion (%) of B + M | Microstructures other than B and M | Average heating rate (° C./sec) to 700° C. | Annealing temperature (° C.) | Holding time (sec) at annealing temperature | Average cooling rate (° C./sec) |
| 1 | 17 | 1.0 | 100 | — | 20 | 780 | 100 | 20 |
| 2 | 17 | 1.0 | 100 | — | 20 | 785 | 100 | 20 |
| 3 | 17 | 1.0 | 100 | — | 20 | 775 | 100 | 20 |
| 4 | 20 | 1.0 | 92 | F | 20 | 795 | 100 | 20 |
| 5 | 9 | 1.8 | 90 | F | 20 | 800 | 100 | 20 |
| 6 | 5 | 0.9 | 95 | F | 20 | 790 | 100 | 20 |
| 7 | 15 | 1.1 | 96 | F | 20 | 800 | 100 | 20 |
| 8 | 23 | 1.2 | 100 | — | 20 | 770 | 100 | 20 |
| 9 | 9 | 0.7 | 90 | F | 20 | 795 | 100 | 20 |
| 10 | 14 | 0.9 | 89 | F | 20 | 830 | 100 | 20 |
| 11 | 10 | 1.0 | 94 | F | 20 | 785 | 100 | 20 |
| 12 | 14 | 1.0 | 88 | F | 20 | 760 | 100 | 20 |
| 13 | 13 | 1.1 | 87 | F | 20 | 825 | 100 | 20 |
| 14 | 20 | 1.2 | 100 | — | 20 | 760 | 100 | 20 |
| 15 | 16 | 1.0 | 100 | — | 20 | 785 | 100 | 20 |
| 16 | 40 | 1.3 | 95 | F | 20 | 775 | 100 | 20 |
| 17 | 10 | 1.0 | 0 | F + P | 20 | 785 | 100 | 20 |
| 18 | 11 | 0.9 | 40 | F | 20 | 825 | 100 | 20 |
| 19 | 13 | 1.1 | 92 | F | 7 | 800 | 100 | 20 |
| 20 | 13 | 1.1 | 92 | F | 20 | 700 | 100 | 20 |
| 21 | 13 | 1.1 | 92 | F | 20 | 900 | 100 | 20 |

TABLE 2-continued

| | | | | | | | | |
|---|---|---|---|---|---|---|---|---|
| 22 | 13 | 1.1 | 92 | F | 20 | 300 | 30 | 20 |
| 23 | 10 | 1.0 | 96 | F | 20 | 805 | 100 | 100 |
| 24 | 10 | 1.0 | 96 | F | 20 | 300 | 100 | 20 |
| 25 | 10 | 1.0 | 96 | F | 20 | 800 | 100 | 20 |
| 26 | 10 | 1.0 | 96 | F | 20 | 795 | 100 | 20 |

| | Heat treatment conditions | | | |
|---|---|---|---|---|
| No. | Cooling end temperature (° C.) | Holding time (sec) at 350-550° C. | Steel | Remarks |
| 1 | 425 | 300 | Cold-rolled steel sheet | Inv. Ex. |
| 2 | 425 | 300 | Galvannealed cold-rolled steel sheet | Inv. Ex. |
| 3 | 425 | 300 | Galvanized cold-rolled steel sheet | Inv. Ex. |
| 4 | 425 | 300 | Cold-rolled steel sheet | Inv. Ex. |
| 5 | 425 | 300 | Cold-rolled steel sheet | Inv. Ex. |
| 6 | 425 | 300 | Cold-rolled steel sheet | Inv. Ex. |
| 7 | 425 | 300 | Cold-rolled steel sheet | Inv. Ex. |
| 8 | 425 | 300 | Hot-rolled steel sheet | Inv. Ex. |
| 9 | 425 | 300 | Cold-rolled steel sheet | Inv. Ex. |
| 10 | 425 | 300 | Cold-rolled steel sheet | Comp. Ex. |
| 11 | 425 | 300 | Cold-rolled steel sheet | Comp. Ex. |
| 12 | 425 | 300 | Cold-rolled steel sheet | Comp. Ex. |
| 13 | 425 | 300 | Cold-rolled steel sheet | Comp. Ex. |
| 14 | 425 | 300 | Cold-rolled steel sheet | Comp. Ex. |
| 15 | 425 | 300 | Cold-rolled steel sheet | Comp. Ex. |
| 16 | 425 | 300 | Cold-rolled steel sheet | Comp. Ex. |
| 17 | 425 | 300 | Cold-rolled steel sheet | Comp. Ex. |
| 18 | 425 | 300 | Cold-rolled steel sheet | Comp. Ex. |
| 19 | 425 | 300 | Cold-rolled steel sheet | Comp. Ex. |
| 20 | 425 | 300 | Cold-rolled steel sheet | Comp. Ex. |
| 21 | 425 | 300 | Cold-rolled steel sheet | Comp. Ex. |
| 22 | 425 | 300 | Cold-rolled steel sheet | Comp. Ex. |
| 23 | 425 | 300 | Cold-rolled steel sheet | Comp. Ex. |
| 24 | 300 | 300 | Cold-rolled steel sheet | Comp. Ex. |
| 25 | 650 | 300 | Cold-rolled steel sheet | Comp. Ex. |
| 26 | 425 | 5 | Cold-rolled steel sheet | Comp. Ex. |

B: bainite,
M: martensite
F: ferrite,
P: pearlite

The starting steel sheets, and the hot-rolled steel sheets, cold-rolled steel sheets, galvanized cold-rolled steel sheets and galvannealed cold-rolled steel sheets obtained as described above were analyzed in the following manner to examine the microstructures and mechanical characteristics of the steel sheets. The results obtained are described in Tables 2 and 3.

Area Fraction of Bainite and Martensite of Starting Steel Sheet

The area fraction of bainite and martensite of the starting steel sheet was determined by etching a cross section in the rolling direction at ¼ sheet thickness with Nital and observing the exposed cross section on a scanning electron microscope (SEM). Five fields of view were observed. Sectional images of microstructures at ×2000 magnification were analyzed to determine the area fractions of respective microstructures present in a randomly selected 50 μm×50 μm square region. The results were averaged to give the area fractions. Black regions seen as massive shapes were regarded as ferrite, and other regions, for example, internal structures such as blocks and packets, were regarded as bainite and martensite.

Grain Size of Bainite and Martensite in Starting Steel Sheet

The determination of the grain size of bainite and martensite started with SEM observation which determined prior austenite grain boundaries in bainite and martensite. Using image analysis, the regions enclosed by the prior austenite grain boundaries were analyzed to measure their areas, from which the equivalent circular diameters were calculated. The results were averaged to determine the grain size.

Bainite and Martensite Block Interval of Starting Steel Sheet

Using SEM/electron backscatter diffraction pattern (EBSP), the length in the minor diameter direction was measured of blocks enclosed by high-angle boundaries with 15° or more misorientation except grain boundaries and packet boundaries. The block interval of bainite and martensite was thus determined.

The hot-rolled steel sheets, cold-rolled steel sheets, galvanized cold-rolled steel sheets and galvannealed cold-rolled steel sheets obtained as described hereinabove were analyzed by the following methods.

Area Fraction of Retained Austenite

The area fraction of retained austenite was determined by X-ray diffractometry using Kα radiation of Co. Specifically, a test piece which offered a measurement face sampled from near ¼ thickness of the steel sheet was analyzed so as to calculate the volume fraction of retained austenite from the ratio of the peak intensities of (200) plane and (211) plane of BCC phase, and (200) plane, (220) plane and (311) plane of FCC phase. Because of being homogeneous three dimensionally, the volume fraction of retained austenite thus obtained was adopted as the area fraction.

Area Fractions of Microstructures Except Retained Austenite Relative to the Whole of Microstructures The area fractions of microstructures except retained austenite relative to the whole of the microstructures were determined by etching a cross section in the rolling direction at ¼ sheet thickness with Nital and observing the exposed cross section on a scanning electron microscope (SEM). Five fields of view were observed. Sectional images of microstructures at ×2000 magnification were analyzed to determine the area fractions of respective microstructures present in a randomly selected 50 μm×50 μm square region. The results were averaged to give the area fractions of the respective microstructures.

Area Fraction of Martensite

White regions which were seen as massive shapes having a relatively smooth surface were regarded as martensite including retained austenite. The area fraction of martensite was determined by subtracting the area fraction of retained austenite described hereinabove from the area fraction of such white regions.

Area Fractions of Ferrite and Bainitic Ferrite

Black regions which were seen as massive shapes and did not include retained austenite or martensite were identified as ferrite, and dark grey regions which were seen as elongated shapes were identified as bainitic ferrite. The areas of these ferrite and bainitic ferrite microstructures were determined and were expressed as the area fractions of the respective microstructures.

Proportion of Martensite (Including Retained Austenite) Adjacent to Bainitic Ferrite The martensite including retained austenite which had been identified by the above method was analyzed to determine the proportion of martensite which was in contact with bainitic ferrite in at least part of its boundary with adjacent microstructures and was not at all in contact with ferrite on its boundary with adjacent microstructures. The proportion of martensite (including retained austenite) adjacent to bainitic ferrite was thus determined.

Mechanical Characteristics

Mechanical characteristics (tensile strength TS, yield point YP, elongation EL) were evaluated with respect to No. 5 test pieces described in JIS Z 2201 by a tensile test in accordance with JIS Z 2241. The direction that was 90° to the rolling direction was adopted as the longitudinal direction (the tensile direction).

Hole Expansion Ratio 100 mm×100 mm test pieces were sampled and tested in accordance with The Japan Iron and Steel Federation Standard JFS T1001. A hole with an initial diameter $d_0$=10 mm was punched, and a conical punch having an apex angle of 60° was elevated so as to expand the hole. The elevation of the punch was stopped when a crack penetrated through the sheet thickness. The diameter d of the punched hole after the penetration of the crack was measured, and the hole expansion ratio was calculated from the following equation:

$$\text{Hole expansion ratio (\%)}=((d-d_0)/d_0)\times 100$$

Steel sheets of the same number were tested three times, and the stretch-flangeability was evaluated based on the average of the hole expansion ratios (λ %).

The product of the tensile strength multiplied by the hole expansion ratio (TS×λ) was calculated to evaluate the balance between strength and workability (stretch-flangeability).

Nano Hardness (Microhardness)

The microhardness was measured with a nano indenter by indenting a total of 550 points at 0.5 μm intervals at 250 μN load on a face at ¼ sheet thickness exposed by electrolytic polishing. The difference in microhardness was obtained by calculating the largest value of the differences in microhardness between one site and each of its adjacent sites (each of four sites which were left, right, above and below itself).

The results of the above measurements are described in Table 3. In the evaluation column in Table 3, ○ indicates that the steel sheet was satisfactory with 980 MPa or higher TS, 22000 MPa·% or higher product of TS multiplied by λ (TS×λ), and 20% or higher EL, and × indicates that the steel sheet was unsatisfactory with any one of TS, EL and TS×λ failing to satisfy the above value.

The steel sheets of Inventive Examples attained 980 MPa or higher TS, 22000 MPa·% or higher product of TS multiplied by λ (TS×λ), and 20% or higher EL, and were thus shown to be excellent in ductility and stretch-flangeability. In contrast, as demonstrated in EXAMPLES, the steel sheets of Comparative Examples which were outside the scope of the present disclosure did not satisfy all of TS, EL and TS×λ and compared very unfavorably to the steel sheets of the present disclosure in terms of any of ductility and stretch-flangeability. In all of Inventive Examples, the steel sheets satisfied:

$$\text{(Area fraction of bainitic ferrite)/(Area fraction of bainitic ferrite+ferrite)}\times 100\geq 75\%$$

TABLE 3

| No. | Steel | Area fraction (%) of F | Area fraction (%) of BF | Total area fraction (%) of F + BF | Area fraction (%) of martensite | Area fraction (%) of retained austenite | Other microstructures | Proportion (%) of M (including retained γ) adjacent to BF | Proportion (%) of 4.0 GPa and smaller differences in microhardness |
|---|---|---|---|---|---|---|---|---|---|
| 1 | A | 5 | 52 | 57 | 25 | 18 | — | 72 | 88 |
| 2 | A | 4 | 51 | 55 | 23 | 22 | — | 77 | 82 |
| 3 | A | 4 | 49 | 53 | 24 | 23 | — | 66 | 78 |
| 4 | B | 2 | 48 | 48 | 28 | 24 | — | 71 | 75 |
| 5 | C | 6 | 56 | 62 | 13 | 25 | — | 78 | 77 |
| 6 | E | 6 | 44 | 50 | 22 | 28 | — | 72 | 83 |
| 7 | F | 8 | 58 | 66 | 20 | 14 | — | 77 | 79 |
| 8 | G | 8 | 48 | 54 | 29 | 17 | — | 78 | 81 |
| 9 | H | 4 | 52 | 56 | 25 | 19 | — | 75 | 86 |
| 10 | I | 13 | 59 | 72 | 18 | 10 | — | 82 | 95 |
| 11 | J | 3 | 40 | 43 | 36 | 21 | — | 77 | 76 |
| 12 | K | 10 | 55 | 65 | 26 | 9 | — | 67 | 78 |
| 13 | L | 15 | 58 | 73 | 16 | 11 | — | 70 | 93 |
| 14 | M | 1 | 44 | 45 | 38 | 17 | — | 81 | 56 |
| 15 | N | 8 | 56 | 64 | 29 | 7 | — | 78 | 72 |

TABLE 3-continued

| | | | | | | | | | |
|---|---|---|---|---|---|---|---|---|---|
| 16 | A | 3 | 52 | 55 | 37 | 8 | — | 82 | 73 |
| 17 | A | 10 | 42 | 52 | 36 | 12 | — | 81 | 64 |
| 18 | I | 13 | 45 | 58 | 36 | 6 | — | 80 | 62 |
| 19 | C | 5 | 57 | 62 | 23 | 15 | — | 55 | 65 |
| 20 | C | 21 | 54 | 75 | 16 | 9 | — | 72 | 85 |
| 21 | C | 2 | 56 | 58 | 25 | 17 | — | 55 | 86 |
| 22 | C | 12 | 41 | 53 | 28 | 19 | — | 74 | 60 |
| 23 | E | 1 | 37 | 38 | 33 | 29 | — | 65 | 88 |
| 24 | E | 28 | 20 | 48 | 45 | 7 | — | 68 | 54 |
| 25 | E | 18 | 0 | 18 | 52 | 1 | P | 0 | 52 |
| 26 | E | 7 | 31 | 38 | 58 | 4 | — | 64 | 62 |

| No. | Proportion (%) of 8.0 GPA and smaller microhardness | TS (MPa) | YP (MPa) | EL (%) | λ (%) | TS × λ (MPa · %) | Evaluation | Remarks |
|---|---|---|---|---|---|---|---|---|
| 1 | 91 | 1054 | 681 | 28.1 | 26 | 27404 | ○ | Inv. Ex. |
| 2 | 89 | 1035 | 676 | 21.0 | 27 | 27945 | ○ | Inv. Ex. |
| 3 | 90 | 1031 | 632 | 23.2 | 26 | 26806 | ○ | Inv. Ex. |
| 4 | 86 | 1188 | 708 | 21.7 | 21 | 24948 | ○ | Inv. Ex. |
| 5 | 92 | 992 | 677 | 30.8 | 26 | 25792 | ○ | Inv. Ex. |
| 6 | 91 | 1054 | 663 | 28.3 | 26 | 27404 | ○ | Inv. Ex. |
| 7 | 96 | 997 | 815 | 21.5 | 23 | 22931 | ○ | Inv. Ex. |
| 8 | 86 | 1073 | 626 | 22.5 | 21 | 22533 | ○ | Inv. Ex. |
| 9 | 93 | 1000 | 695 | 28.0 | 27 | 27000 | ○ | Inv. Ex. |
| 10 | 96 | 812 | 621 | 18.0 | 24 | 19488 | X | Comp. Ex. |
| 11 | 74 | 1284 | 830 | 15.4 | 11 | 14124 | X | Comp. Ex. |
| 12 | 86 | 982 | 679 | 16.2 | 21 | 20622 | X | Comp. Ex. |
| 13 | 92 | 897 | 708 | 21.6 | 21 | 18837 | X | Comp. Ex. |
| 14 | 72 | 1245 | 894 | 12.5 | 13 | 16185 | X | Comp. Ex. |
| 15 | 93 | 996 | 724 | 19.2 | 13 | 12550 | X | Comp. Ex. |
| 16 | 72 | 1234 | 946 | 14.3 | 12 | 14808 | X | Comp. Ex. |
| 17 | 81 | 1165 | 894 | 16.8 | 15 | 17475 | X | Comp. Ex. |
| 18 | 85 | 1262 | 836 | 15.2 | 14 | 17668 | X | Comp. Ex. |
| 19 | 77 | 1184 | 902 | 13.5 | 11 | 13024 | X | Comp. Ex. |
| 20 | 96 | 854 | 689 | 23.5 | 25 | 21350 | X | Comp. Ex. |
| 21 | 82 | 1012 | 667 | 18.5 | 13 | 13155 | X | Comp. Ex. |
| 22 | 89 | 1037 | 660 | 15.6 | 15 | 15555 | X | Comp. Ex. |
| 23 | 94 | 1264 | 906 | 13.4 | 13 | 16432 | X | Comp. Ex. |
| 24 | 67 | 1324 | 836 | 11.4 | 8 | 10592 | X | Comp. Ex. |
| 25 | 62 | 1121 | 728 | 13.2 | 15 | 16815 | X | Comp. Ex. |
| 26 | 65 | 1256 | 911 | 12.0 | 8 | 10048 | X | Comp. Ex. |

Retaine γ: retained austenite, M: martensite, BF: bainitic ferrite, F: ferrite, P: pearlite
Evaluation ○: satisfactory, X: unsatisfactory

The invention claimed is:

1. A high-strength steel sheet having a chemical composition comprising:

C: 0.10% to 0.35%, by mass %,
Si: 0.5% to 2.0%, by mass %,
Mn: 1.5% to 3.0%, by mass %,
P: not more than 0.050%, by mass %,
S: not more than 0.0100%, by mass %,
Al: 0.001% to 1.00%, by mass %,
N: 0.0005% to 0.0200%, by mass %, and
iron and inevitable impurities,
wherein:
a ratio of C/Mn is from 0.08 to 0.20,
the steel sheet has microstructures including, in terms of area fraction relative to all the microstructures:
less than 10% ferrite,
40% to 70% total of ferrite and bainitic ferrite,
5% to 35% martensite, and
5% to 30% retained austenite,
a proportion of martensite including retained austenite adjacent to bainitic ferrite being not less than 60% of all martensite including retained austenite,
a proportion of 4.0 GPa and smaller differences in microhardness measured at 0.5 μm intervals being not less than 70% of all indentations, and
a proportion of microstructures with 8.0 GPa or smaller microhardness being not less than 85% of all the microstructures.

2. The high-strength steel sheet according to claim 1, wherein the chemical composition further comprises at least one element selected from at least one of groups A to C:

Group A:
one or more selected from:
Ti: 0.005% to 0.100%, by mass %,
Nb: 0.005% to 0.100%, by mass %, and
V: 0.005% to 0.100%, by mass %,
Group B:
one or more selected from:
Cr: 0.05% to 1.0%, by mass %,
Ni: 0.05% to 0.50%, by mass %,
Mo: 0.05% to 1.0%, by mass %,
Cu: 0.005% to 0.500%, by mass %, and
B: 0.0001% to 0.0100%, by mass %, and
Group C:
either one or both of:
Ca: 0.0001% to 0.0050%, by mass %, and
REM: 0.0005% to 0.0050%, by mass %.

3. A method for manufacturing a high-strength steel sheet, the method comprising:

providing a steel sheet having a chemical composition comprising:
C: 0.10% to 0.35%, by mass %,
Si: 0.5% to 2.0%, by mass %,
Mn: 1.5% to 3.0%, by mass %, P: not more than 0.050%, by mass %,
S: not more than 0.0100%, by mass %,
Al: 0.001% to 1.00%, by mass %,
N: 0.0005% to 0.0200%, by mass %, and
iron and inevitable impurities,
wherein:
a ratio of C/Mn is from 0.08 to 0.20, and
the steel sheet includes microstructures in which a total of bainite and martensite, both having a grain size of 1 μm to 25 μm and a block interval of not more than 3 μm, represents not less than 80% of all the microstructures, heating the steel sheet to 700° C. at an average heating rate of not less than 15° C./sec, holding the steel sheet at a temperature in the range of 740° C. to 860° C. for 60 seconds to 600 seconds, cooling the steel sheet to a temperature in the range of 350° C. to 550° C. at an average cooling rate of not more than 50° C./sec, and after cooling the steel sheet, subsequently holding the steel sheet at a temperature in the range of 350° C. to 550° C. for 30 seconds to 1200 seconds, where the high-strength steel sheet has microstructures including less than 10% ferrite in terms of area fraction relative to all the microstructures.

4. The method for manufacturing a high-strength steel sheet according to claim 3, wherein the chemical composition further comprises at least one element selected from at least one of groups A to C:

Group A:
one or more selected from:
Ti: 0.005% to 0.100%, by mass %,
Nb: 0.005% to 0.100%, by mass %, and
V: 0.005% to 0.100%, by mass %, Group B:
one or more selected from:
Cr: 0.05% to 1.0%, by mass %,
Ni: 0.05% to 0.50%, by mass %,
Mo: 0.05% to 1.0%, by mass %,
Cu: 0.005% to 0.500%, by mass %, and
B: 0.0001% to 0.0100%, by mass %, and Group C:
either one or both of:
Ca: 0.0001% to 0.0050%, by mass %, and
REM: 0.0005% to 0.0050%, by mass %.

5. The method for manufacturing a high-strength steel sheet according to claim 3, further comprising performing a coating treatment.

6. The method for manufacturing a high-strength steel sheet according to claim 4, further comprising performing a coating treatment.

7. The method for manufacturing a high-strength steel sheet according to claim 5, wherein the coating treatment is a hot dip coating or an electrocoating.

8. The method for manufacturing a high-strength steel sheet according to claim 6, wherein the coating treatment is a hot dip coating or an electrocoating.

9. The method for manufacturing a high-strength steel sheet according to claim 5, further comprising performing an alloying treatment at an alloying temperature of 450 to 600° C. after the coating treatment.

10. The method for manufacturing a high-strength steel sheet according to claim 6, further comprising performing an alloying treatment at an alloying temperature of 450 to 600° C. after the coating treatment.

11. The method for manufacturing a high-strength steel sheet according to claim 7, further comprising performing an alloying treatment at an alloying temperature of 450 to 600° C. after the coating treatment.

12. The method for manufacturing a high-strength steel sheet according to claim 8, further comprising performing an alloying treatment at an alloying temperature of 450 to 600° C. after the coating treatment.

13. The high-strength steel sheet according to claim 1, wherein the steel sheet has 20% to 35% martensite.

14. The high-strength steel sheet according to claim 1, wherein the steel sheet has not more than 8% ferrite.

15. The high-strength steel sheet according to claim 1, wherein the steel sheet has 2% to 8% ferrite.

* * * * *